US006105358A

United States Patent [19]

Zeballos

[11] Patent Number: 6,105,358

[45] Date of Patent: Aug. 22, 2000

[54] ROPE CHAIN

[76] Inventor: Pedro Fernandez Zeballos, La Paz, Bolivia

[21] Appl. No.: 08/449,768

[22] Filed: May 24, 1995

[51] Int. Cl.[7] ..... F16G 13/00; B21L 5/02

[52] U.S. Cl. ..... 59/80; 59/82

[58] Field of Search ..... 59/80, 35.1, 82, 59/3

[56] References Cited

U.S. PATENT DOCUMENTS

| | | | |
|---|---|---|---|
| 4,651,517 | 3/1987 | benhamou et al. | 59/80 |
| 4,934,135 | 6/1990 | rozenwasser | 59/80 |
| 4,996,835 | 3/1991 | rozenwasser | 59/80 |
| 5,185,995 | 2/1993 | dal monte | 59/80 |
| 5,361,575 | 11/1994 | rozenwasser | 59/80 |

*Primary Examiner*—David Jones

*Attorney, Agent, or Firm*—Ostrolenk, Faber, Gerb & Soffen, LLP

[57] ABSTRACT

A jewelry rope chain having a double helix appearance formed from a plurality of interlaced links or rings of wire is disclosed. Each link is made from a wire loop having a gap, wherein the wire loop has a cross-section with a major axis defining a long diametrical dimension and a minor axis defining a short diametrical dimension. The long diametrical dimension is disposed in a plane defined by a diameter of the link and the short diametrical dimension is perpendicular to the long diametrical dimension. A ratio of the long diametrical dimension to the short diametrical dimension is less than 1.3:1. The gap of the wire loop is narrower than the long diametrical dimension of the loop cross-section.

3 Claims, 6 Drawing Sheets

B > A B > C

ROPE CHAIN

BACKGROUND OF THE INVENTION

1. Field of the Invention

The present invention is directed to rope chain jewelry made of a precious metal. More precisely, the present invention is directed to unique wire links interlaced together to form a rope chain.

2. Description of the Prior Art and Related Information

Jewelry rope chains have been for decades been made by hand. The basic construction element used to assemble a rope chain was an annular link cut from a solid wire stock. The wire stock was preferably made of a precious metal such as 14 karat gold.

FIG. 1 shows such a prior art link 1 which has a gap g, with an inner circumferential chord distance B. In conventional rope chains, the inner circumferential chord B of the gap g in each link is slightly larger than the cross section of the link 1 so that one link can pass through the gap of another link. By assembling one link to another, an entire rope chain can be built in this manner. Indeed, a rope chain having the appearance of a double helix is commonly built in this fashion.

It is clear that this is a labor intensive process, but, with good workmanship, the final product is typically very attractive. There have been efforts to automate the process, but the quality of a machine-made rope chain is lower than a hand-made rope chain.

To make the link, a wire formed from a precious metal having a circular cross section is wound around a mandrel to give the wire a coiled shape. The coil is next cut at eccentric angles so that the respective gaps of each link are staggered. The thickness of the cutting disk somewhat determines the gap size.

Because the cut links still retain their coiled shape, the ends of the link are not co-planar. Thus, each link is accordingly pressed between pressure rollers to flatten the link thereby cold working the entire link so that it lies within a single plane. The flattening pressure creates opposed flat surfaces on diametrically opposed sides of the link. The flattening pressure also bends the link so that the flat faces are parallel to the plane defined by the circumference of the link. Also, after flattening, the ends of the link forming the gap lie in the same plane.

Conventional rope chains were made from split annular rings having approximately a 3:1 ratio of inner diameter to the major wire dimension. U.S. Pat. No. 4,651,517 to Benhamou disclosed that it was possible to substantially reduce the amount of precious metal required to produce a rope chain of equivalent dimension by using a thinner wire annular ring and changing the ratio of ring inner diameter to major wire dimension to just over X times greater than the major wire dimension, wherein X is an odd number greater than 3. Thus, by having the ratio of ring inner diameter to major wire dimension of approximately 5:1, 7:1, etc., it was possible to obtain rope chains of similar diameter and length as the 3:1 ratio rope chain, but with a significant reduction of precious metal weight used in the chain.

U.S. Pat. No. 4,996,835 to Rozenwasser disclosed that further weight savings can be achieved in producing a rope chain by using non-circular, elongated shaped rings having a major axis defining longer outer and inner diameters, and a minor axis defining shorter outer and inner diameters, wherein the gap was oriented in a link section parallel to the major axis and the shorter inner diameter was just over X times greater than the cross-section of the link wire. Variable X was a number equal to or greater than 2, and the links were positioned in the chain so that the longer outer diameter defined the width of the chain.

U.S. Pat. No. 5,185,995 to Dal Monte disclosed a jewelry rope chain having link members having an outer peripheral volume and an inner peripheral volume, the boundary between said outer and inner peripheral volumes being defined by a phantom bisecting surface drawn midway between an outermost perimeter and an innermost perimeter of each link member, wherein the link wire had a majority of its weight lying within said outer peripheral volume of said link member and a balance of its weight lying within said inner peripheral volume of said link member. Dal Monte thus disclosed a jewelry rope chain having reduced the amount of precious metal without increasing the number of links needed to assembly the rope chain of a given width, or outside diameter, and length by modifying only the shape of the cross-section of the wire used to form the individual links.

U.S. Pat. No. 5,361,575 to Rozenwasser disclosed a jewelry rope chain comprised of a plurality of links wherein each link featured a wire cross-section including a major axis defining a longer dimension and a minor axis defining a shorter dimension, said longer dimension being in the plane of the link and the shorter dimension being perpendicular thereto, the ratio of said longer dimension to said shorter dimension being greater than 1.3:1 but less than 3:1. Further, the gap of each chain link was narrower than the longer dimension of the wire cross-section of the link.

In view of the foregoing, there is still a need for reducing the quantity of precious metal without increasing the number of links required to assemble an entire rope chain of a given a outside diameter and rope chain length. Further, the appearance of the rope chain should be smooth, tight, and non-corrugated to be attractive to the consumer.

SUMMARY OF THE INVENTION

In view of the foregoing, it is therefore an object of the present invention to provide a rope chain made from a precious metal that benefits from substantial weight savings to minimize the amount of that precious metal used for a rope chain of a given dimension. It is another object of the present invention to provide such a weight savings in a rope chain using conventional round links having a 3:1 ratio of inner ring diameter to major wire cross-section dimension. It is another object of the present invention to provide improved weight savings in a jewelry rope chain made with links having any cross-sectional shape. It is yet another object of the present invention to provide a jewelry rope chain having smooth, tight, and non-corrugated appearance.

In view of the foregoing, the present invention provides a jewelry rope chain having a double helix appearance formed from a plurality of interlaced links of wire wherein each link comprises a wire loop having a gap, said wire loop having a cross-section wherein a major axis defining a long diametrical dimension and a minor axis defining a short diametrical dimension, wherein said long diametrical dimension is disposed in a plane defined by the link and the short diametrical dimension is perpendicular to the long diametrical dimension, and wherein a ratio of said long diametrical dimension to said short diametrical dimension is less than 1.3:1. In a preferred embodiment of the present invention, the gap of each loop is narrower than the long diametrical dimension of the loop cross-section.

Contrary to the teachings of the prior art, applicant has discovered that, by careful selection of design parameters defined in the foregoing, one can obtain a jewelry rope chain that is even lighter in weight than in conventional jewelry rope chains of a given length and outer diameter. Indeed, the present invention rope chain achieves a 25% weight reduction over the rope chains produced in accordance with U.S. Pat. No. 5,361,575 to Rozenwasser.

BRIEF DESCRIPTION OF THE DRAWINGS

The objects, features, and advantages of the present invention will be apparent to one skilled in the art from reading the following detailed description and viewing the drawings in which.

DETAILED DESCRIPTION OF THE INVENTION

Figure 1:
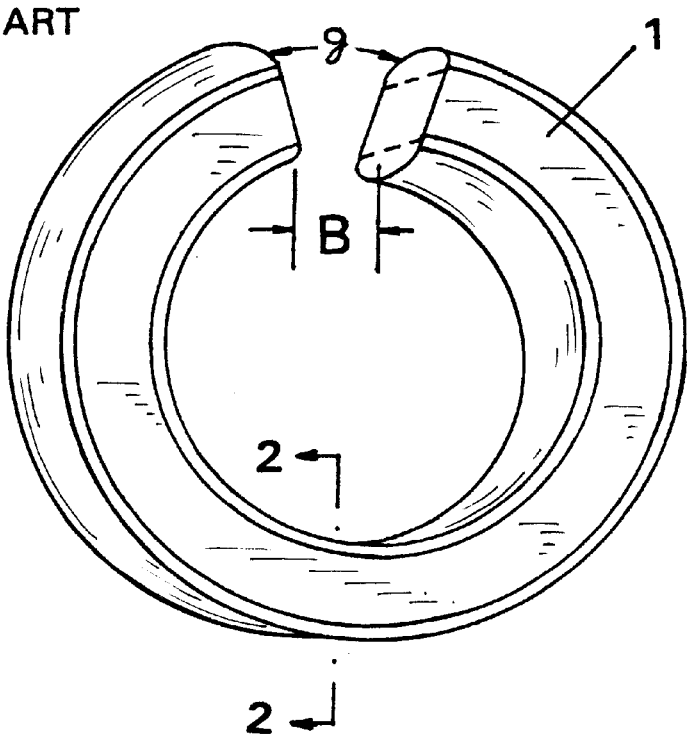
FIG. 1 PRIOR ART
FIG. 1 is a plan view of a conventional prior art link for making a jewelry rope chain.

The following specification describes a jewelry rope chain. In the description, specific materials and configurations are set forth in order to provide a more complete understanding of the invention. It is understood by those skilled in the art, however, that the present invention can be practiced without those specific details.

The present invention is directed to a jewelry rope chain having preferably a double helix appearance formed from a plurality of interlaced links of wire wherein each link includes a gap and has a cross-section including a major axis defining a long diametrical dimension and a minor axis defining a short diametrical dimension. The long diametrical dimension is disposed in a plane generally defined by a diameter of the link and the short diametrical dimension is perpendicular to the long diametrical dimension. In a preferred embodiment of the present invention, the ratio of the long diametrical dimension to said short diametrical dimension is less than 1.3:1. A jewelry rope chain having individual links of whatever cross-sectional shape made to this specification is lighter in weight for any given length and outside diameter of the jewelry rope chain.

In a preferred embodiment, the present invention links are fabricated according to particular process parameters in order to manufacture lighter rope chains. The rope chains preferably have a 20% to 30% weight reduction in relation to conventional rope chains.

The basic principle in the manufacture of rope chains of any size, form, or weight is the same. The variances are the parameter for the manufacture of the link, such as wire diameter, mandrel diameter, the cut to give the openness to the ring and the link flatten process. In order to find the parameters to manufacture 3R rope chain, a series of mathematical and practical formulas have been calculated which produced dimensions for the links. The characteristics for the preferred embodiment rings or links are shown in the following table:

| CALIBER | EXTERNAL DIAMETER | WEIGHT (14 KT) |
|---|---|---|
| 14 (3R) | 2.00 mm | 0.223 gm |
| 16 (3R) | 2.25 mm | 0.265 gm |
| 18 (3R) | 2.50 mm | 0.359 gm |
| 21 (3R) | 2.75 mm | 0.537 gm |
| 23 (3R) | 3.00 mm | 0.622 gm |
| 25 (3R) | 3.50 mm | 0.742 gm |
| 30 (3R) | 4.00 mm | 1.039 gm |
| 35 (3R) | 5.00 mm | 1.336 gm |
| 40 (3R) | 6.00 mm | 1.771 gm |
| 50 (3R) | 7.00 mm | 3.194 gm |

In order to obtain the above listed weights and diameters, applicant applied the following design calculations. The results were used by applicant as a master in order to develop the parameters which are being used in the manufacture the links or rings for the 3R rope chain.

CALCULATION FOR A 14 KT

RING 3R ROPE CHAIN (THEORETICAL)

| | |
|---|---|
| Caliber | = 0.018 |
| External diameter (ordered) | = 2.5 |
| Weight/Inch (ordered) | = 0.359 |
| Wire diameter (calculated) | = 0.362 mm |
| Mandrel diameter (calculated) | = 1.50 mm |
| Cutting disk thickness, 9% less than the diameter of the non-flattened wire | = 0.347 mm |
| Flattening process 15% to 20% less than the original wire | = 0.325 mm |
| Mandrel diameter of conventional rings (calculation key) | 0.018 = 1.55 mm |

To the required weight of 0.359, applicant added 17.5% more to compensate for the weight loss during the stripping and diamond cutting process. This compensation amounted to a weight of 0.422 gm per inch.

Computation of number of rings per inch $$X = \frac{1}{0.018''} = 56 \text{ rings}$$

Weight per ring $$\frac{0.422}{56} = 0.00754 \text{ grs.}$$

Volume per ring = V = F/o $$V = \frac{0.00754 \text{ grs}}{13.5 \text{ gr/cm}^3} \times \frac{1000 \text{ mm}^3}{1 \text{ cm}^3} = 0.558 \text{ mm}^3$$

Wire diameter calculation $$V = \frac{d2 \times \pi \times h}{4} \text{ so that } d2 = \frac{V \times 4}{\pi \times h}$$

-continued $$d2 = \frac{0.558 \times 4}{3.1416 \times 4.87}$$

where h = height = π × diameter conventional mandrel
d = 0.392 MM
h = 3.1416 × 1.55
h = 4.87 MM
Theoretical calculation to find mandrel's diameter Mandrel diameter = Ext. Dia. −4((0.382 × 2)/(0.382–0.325))
Mandrel diameter = 2.5 − (0.764/0.228)
Mandrel diameter = 2.5–0.992
Mandrel diameter = 1.50

The smaller calibers such as 014, 016 and 018 3R are made in ring machines having a unique cutting disk inserted in the mandrel. During rotation of the mandrel, and cutting the rings at the same time, it is possible to form rings that widen a little bit the diameter of the ring. The cutting disk has a thickness of 9% less than the non-flattened ring. The flattening process for this type of ring is approximately 15% to 20% less than the original wire diameter, flattening the central part of the lateral sides of the ring increasing the ring's size.

Big calibers such as 021, 023, 025, 030, 035, 040 and 050 3R are made in flattening machines that perform a cutting process that is independent of the flattening process. Previous to the cutting process, applicant made 14 KT gold wire spirals in a mandrel Then, the spirals go through a die in which a cutting disk rotates.

Applicant performed a series of tests with respect to the theoretical calculation in order to find the following parameters shown in the next tables:

| CAL. | WIRE DIAMETER | MANDREL DIAMETER | CUTTING DISK | FLATTENING PROCESS | EXT. DIAMETER | WEIGHT GM/INCH |
|---|---|---|---|---|---|---|
| 014 | 0.30 mm | 1.10 mm | 0.011" | 0.24 | 1.90 mm | 0.220 |
| 016 | 0.35 mm | 1.30 mm | 0.012" | 0.28 | 2.20 mm | 0.300 |
| 018 | 0.38 mm | 1.40 mm | 0.014" | 0.32 | 2.45 mm | 0.364 |
| 021 | 0.45 mm | 1.70 mm | 0.012" | 0.38 | 2.75 mm | 0.513 |
| 023 | 0.50 mm | 1.90 mm | 0.012" | 0.42 | 3.00 mm | 0.619 |
| 025 | 0.55 mm | 2.20 mm | 0.012" | 0.46 | 3.50 mm | 0.780 |
| 030 | 0.65 mm | 2.41 mm | 0.012" | 0.52 | 3.95 mm | 0.990 |
| 035 | 0.76 mm | 2.75 mm | 0.014" | 0.60 | 4.75 mm | 1.330 |
| 040 | 0.90 mm | 3.40 mm | 0.016" | 0.76 | 5.85 mm | 1.850 |
| 050 | 1.15 mm | 3.90 mm | 0.020" | 0.90 | 6.85 mm | 2.800 |

Accordingly, the finished look of applicant's 3R rope chain is externally and internally rounded; applicant achieves this with the flattening process (the roller flattens the central part of the ring). The flattening process also serves as a regulating parameter of the external diameter of the rope chain. The flattening process gives applicant the form of the ring's openness or gap size, which means that the external diameter of the openness has a greater longitudinal dimension than the openness of the internal diameter. This openness difference makes possible a better and more efficient union of the rings in the weaving and assembly process.

The openness or ring gap size must be bigger than the thickness of the flattened ring; it is very important not to flatten the ring in excess because this would cause looseness in the rings in the weaving process. As a result, it would be a difficult soldering process during the finishing steps of the rope chain.

The section which follows below as Appendix A provides the detailed calculations for various sizes of rings for rope chains of different dimensions. The nomenclature for the variables used in the calculations is set forth in of Appendix A.

Notably, variable B defines the "openness" or gap size of the flattened link. The openness B of the flattened link should have been equal to the thickness of the cutting disk, but the gap increases due to the flattening process. Such an increase in openness or gap size ranges from 12 to 28 percent of the thickness of the cutting disk.

Also, the mandrel diameter used for the different calibers should have been equal to the internal or inside diameter of the link, but applicant adjusted the value of the inside diameter due to flattening of the link, which increases the inside diameter. Empirical evidence shows that the flattening process increases the inside diameter of the link 3.5 to 8.5 percent.

If the rings or links are fabricated according to the parameters defined in Appendix A, the finished link has an aspect ratio of the long diametrical dimension (variable A) to the short diametrical dimension (variable C) of less than 1.3:1. This is shown in of Appendix A.

APPENDIX A

CALIBRE 014 3R

FIG. #1

1) External Diameter = Int Diam + Diam inicial wire * 2 + (increment *

APPENDIX A-continued flattened)*2

Where = Int. Diam = Mandrel Diam + 3.5% increment in Mandrel diameter

Int. Diam = 1.15 + 0.04
(D) Int. Diam = 1.19 mm.
Initial wire diameter = 0.30 mm.
Thickness of flattened link = 0.27 mm.
(E) Ext. diam = 1.19 + 0.30*2 + (0.30 − 0.27)2
(E) Ext. Diam = 1.19 + 0.6 + 0.06
(E) Ext. Diam = 1.85 mm APPENDIX A-continued $$\text{Relation} = \frac{\text{Int. Diam}}{\text{Diam flattened link}} = \frac{D}{A} = \frac{1.19}{0.33} = 3.6:1$$

FIG. #2

$$\text{Increm} = \text{flattened link (F)} = \frac{\text{Initial wire Diam} - \text{Thickness flattened link}}{2}$$

$$F = \frac{0.30 - 0.27}{2} = 0.015 \text{ mm}$$

FIG. #3

Are transversal views of a flattened link where it shows:
(A) = Initial wire Diam + (the increment for the flattenig of the link)
(C) = Thickness of the flattened link where:
A = 0.30 + (0.30 − 0.27)
A = 0.33 mm
C = 0.27

$$\text{Relation} = \frac{A}{C} = \frac{0.33}{0.27} = 1.22:1$$

FIG. #4

Opennes of the link (B) = cutting disk thickness + 15% more over the cutting disk thickness
B = 0.30 + 15%
B = 0.30 + 0.045
B = 0.345 mm $$\text{Relation} = \frac{B}{A} = \frac{0.345}{0.33} = 1.045:1$$

CALIBRE 016 3R

FIG #1

Int. Diam = 1.30 + 4.4% increment in mandrel Diam
Int. Diam = 1.30 + 0.057
(D) Int. Diam = 1.36
Ext. Diam = 1.36 + 0.38 * 2 + (0.38 − 0.34)2
Ext. Diam = 1.36 + 0.76 + 0.08
(E) Ext. Diam = 2.2 mm $$\text{Relation} = \frac{D}{A} = \frac{1.36}{0.42} = 3.24:1$$

FIG. #2

$$F = \frac{0.38 - 0.34}{2} = \frac{0.04}{2} = 0.02 \text{ mm}$$

FIG. #3

Thickness of flattened (C) = 0.34 mm
A = 0.38 + (0.38 − 0.34)
A = 0.42 mm
C = 0.34 mm
lation A/C = 0.42/0.34 = 1.24:1

FIG. #4

B = Thickness of the cutting disk + 18% over the thickness of the cutting disk.
B = 0.37 + 18%
B = 0.37 + 0.067
B = 0.44
Relation B/A = 0.44/0.42 = 1.048:1

CALIBRE 016 D/C

FIG. #1

Int. Diam = 1.5 + 4.46%
Int. Diam = 1.5 + 0.067
Int. Diam = 1.57 mm
(D) Ext. Diam = 1.57 + 0.40 * 2 + (0.40 − 0.36)2
(E) Ext. Diam = 2.45 mm $$\text{Relation } \frac{D}{A} = \frac{1.57}{0.44} = 3.57:1$$

FIG. #2

$$F = \frac{0.40 - 0.36}{2} = 0.02 \text{ mm}$$

FIG. #3

A = 0.40 + (0.40 − 0.36)
A = 0.44 mm
C = 0.36 mm
Relation A/C = 0.44/0.36 = 1.22:1

FIG. #4

B = Thickness of the cutting disk + 19% Increment
B = 0.39 + 19%
B = 0.39 + 0.074
B = 0.464 mm
Relation B/A = 0.464/0.44 = 1.055:1

CALIBRE 021 3R

FIG. #1

Int. Diam = 1.70 + 5%
Int. Diam = 1.70 + 0.085
(D) Int. Diam = 1.79 mm
Ext. Diam = 1.79 + 0.45 * 2 + (0.45 − 0.41)2
Ext. Diam = 2.77 mm
Relation D/A 1.79/0.49 = 3.65:1

FIG. #2

$$F = \frac{0.45 - 0.41}{2} = 0.02 \text{ mm}$$

FIG. #3

A = 0.45 + (0.45 − 0.41)
A = 0.49 mm
C = 0.41 mm
Relation A/C = 0.49/0.41 = 1.20:1

FIG. #4

B = Thickness of the cutting disk + 15% increment
B = 0.46 + 15%
B = 0.46 + 0.069
B = 0.529 mm
Relation B/A = 0.529/0.49 = 1.080:1

CALIBRE 023 3R

FIG. #1

Int. Diam = 1.82 + 4.21%
Int. Diam = 1.82 + 0.077
(D) Int. Diam = 1.90 mm (external diam = 1.9 + 1.1 = 3 cm)
Relation D/A = 1.9/0.55 = 3.46:1

FIG. #2

$$F = \frac{0.50 - 0.45}{2} - 0.025 \text{ mm}$$

FIG. #3

A = 0.50 + (0.50 − 0.45)
A = 0.55 mm
C = 0.45 mm
Relation A/C = 0.55/0.45 = 1.22:1

APPENDIX A-continued

FIG. #4

B = Thickness of the cutting + 18% increment
B = 0.48 + 0.086
B = 0.57 mm
Relation B/A = 0.57/0.55 = 1.036:1

CALIBRE 025 3R

FIG. #1

Int. Diam = 2.2 + B 33%
Int. Diam = 2.2 + 0.183
(D) Int. Diam = 2.4 mm
(E) Ext. Diam = 2.4 + 0.55 * 2 + (0.55 − 0.50)2
Ext. Diam = 3.6 mm
Relation D/A = 2.4/0.6 = 4:1

FIG. #2

$$\Gamma = \frac{0.55 - 0.50}{2} - 0.025 \text{ mm}$$

FIG. #3

A = 0.55 + (0.55 − 0.50)
A = 0.55 + 0.05
A = 0.60 C = 0.50
Relation A/C = 0.60/0.50 = 1.2:1

FIG. #4

B = Thickness of the cutting disk + 24% increment
B = 0.51 + 0.122
B = 0.63 mm
Relation B/A = 0.63/0.60 = 1.050:1

CALIBRE 030 3R

FIG. #1

Int. Diam = 2.4 + 4%
Int. Diam = 2.4 + 0.096
(D) Int. Diam = 2.5 mm
(E) Ext. Diam = 2.5 + (0.65 * 2) + (0.65 − 0.60)2
Ext. Diam = 3.9 mm
Relation D/A = 2.5/0.7 = 3.57:1

FIG. #2

$$F = \frac{0.65 - 0.6}{2} - 0.025 \text{ mm}$$

FIG. #3

A = 0.65 + (0.65 − 0.60)
A = 0.70 mm
C = 0.60 mm
Relation A/C = 0.70/0.60 = 1.16:1

FIG. #4

B = Thickness of the cutting + 28% increment
B = 0.56 + 0.157
B = 0.72 mm
Relation B/A = 0.72/0.70 = 1.029:1

CALIBRE 035 3R

FIG. #1

Int. Diam = 2.8 + 11.4%
Int. Diam = 2.8 + 0.36
(D) Int. Diam = 3.16 mm
(E) Ext. Diam = 3.16 + 0.75 * 2 + (0.75 − 0.68)2
Ext. Diam = 4.8 mm
Relation D/A = 3.16/0.82 = 3.85:1

FIG. #2

$$F = \frac{0.75 - 0.68}{2} = 0.035 \text{ mm}$$

APPENDIX A-continued

FIG. #3

A = 0.75 + (0.75 − 0.68)
A = 0.82
Relation A/C = 0.82/0.68 = 1.21:1

FIG #4

B = Thickness of the cutting disk + 27% increment
B = 0.66 + 27%
B = 0.66 + 0.18
B = 0.84 mm
Relation B/A = 0.84/0.82 = 1.024:1

CALIBRE 040 3R

FIG. #1

Int. Diam = 3.5 + 11.7%
Int. Diam = 0.41 + 3.5
(D) Int. Diam = 3.9 mm
(E) Ext. Diam = 3.9 + 0.90 * 2 + (0.9 − 0.85)2
Ext. Diam = 5.8 mm
Relation D/A = 3.9/0.95 = 4.1:1

FIG. #2

$$F = \frac{0.90 - 0.85}{2} = 0.025 \text{ mm}$$

FIG. #3

A = 0.90 + (0.90 − 0.85)
A = 0.95 mm
Relation A/C = 0.95/0.85 = 1.12:1

FIG #4

B = Thickness of the cutting disk + 20% increment
B = 0.81 + 20%
B = 0.81 + 0.162
B = 0.972 mm
Relation B/A = 0.972/0.95 = 1.023:1

NOMENCLATURE.

A = Initial wire diameter plus the increment due to the flattening.
B = Openness of the flattened link.
C = Thickness of the flattened link.
D = Inner diameter of the link.
E = External diameter of the link.
F = Increment of the link's size due to the flattening.

CONCLUSIONS.

Figure 2:
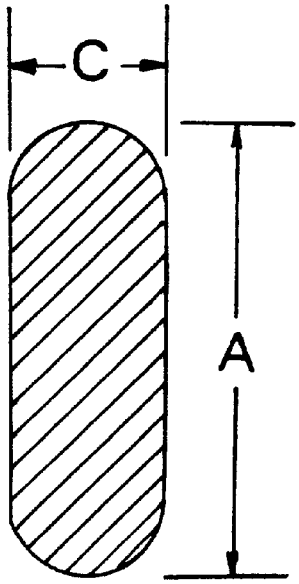
FIG. 2 is a cross-section of the conventional prior art link wire of FIG. 1 taken along line 2—2 of FIG. 1.
Figure 3A:
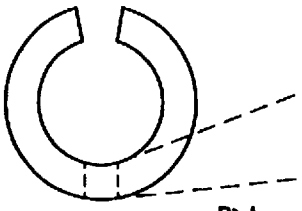
FIGS. 3A–3C, 4A–4C, 5A–5C, 6A–6C, 7A–7C, 8A–8C, 9A–9C, 10A–10C, 11A–11C, 12A–12C, 13, and 14A–14C diagrammatically illustrate the different dimensions of chain links for different caliber links as taught by the present invention.
Figure 3B:
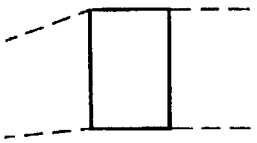
Figure 3C:
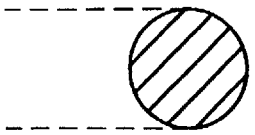
Figure 4A:
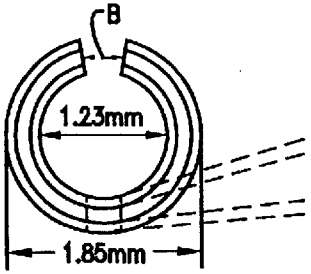
Figure 4B:
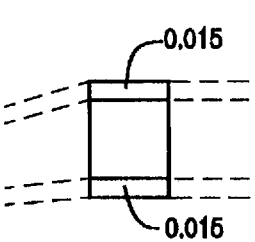
Figure 4C:
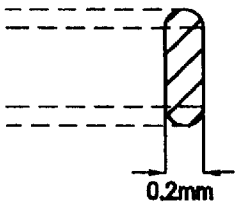
Figure 5A:
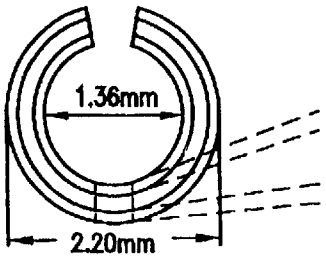
Figure 5B:
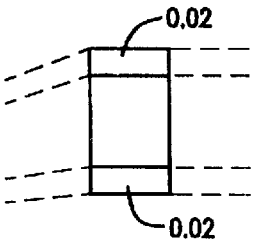
Figure 5C:
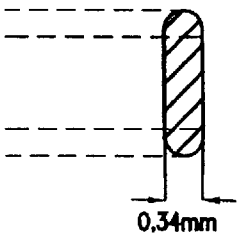
Figures 6A, 6B, 6C, 7A, 7B, 7C, 8A, 8B, 8C:
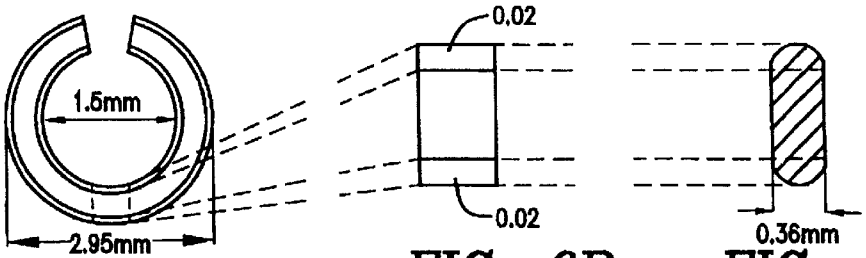
Figure 9A:
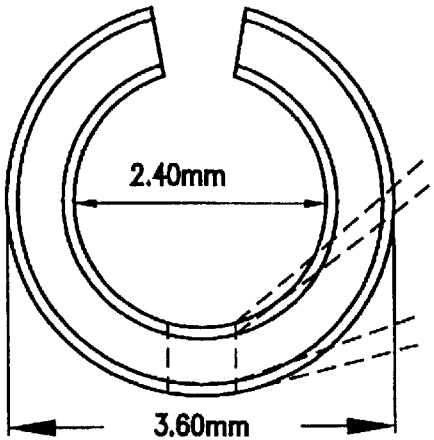
Figure 9B:
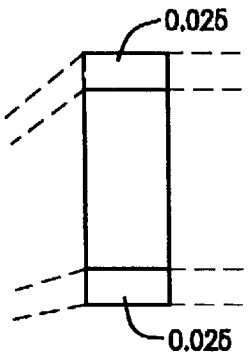
Figure 9C:
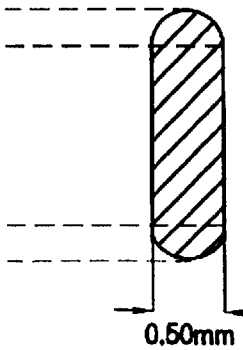
Figure 10A:
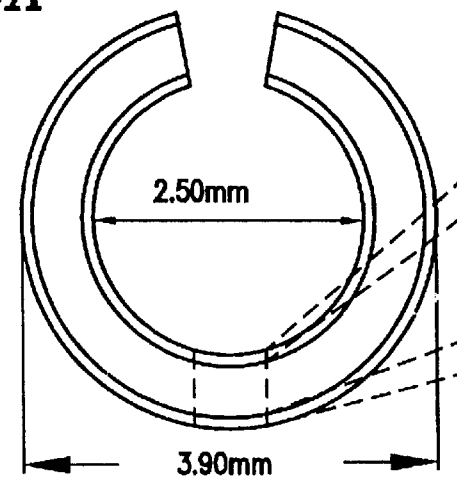
Figure 10B:
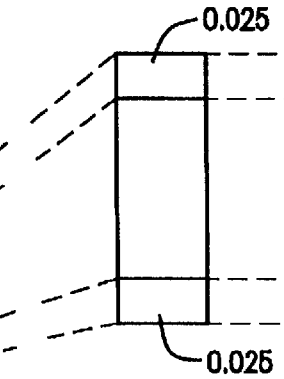
Figure 10C:
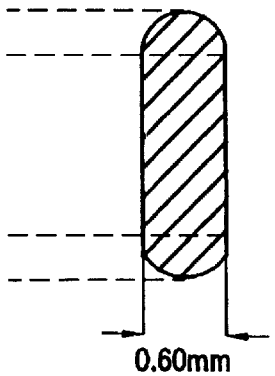
Figures 11A, 11B, 11C, 12A, 12B, 12C:
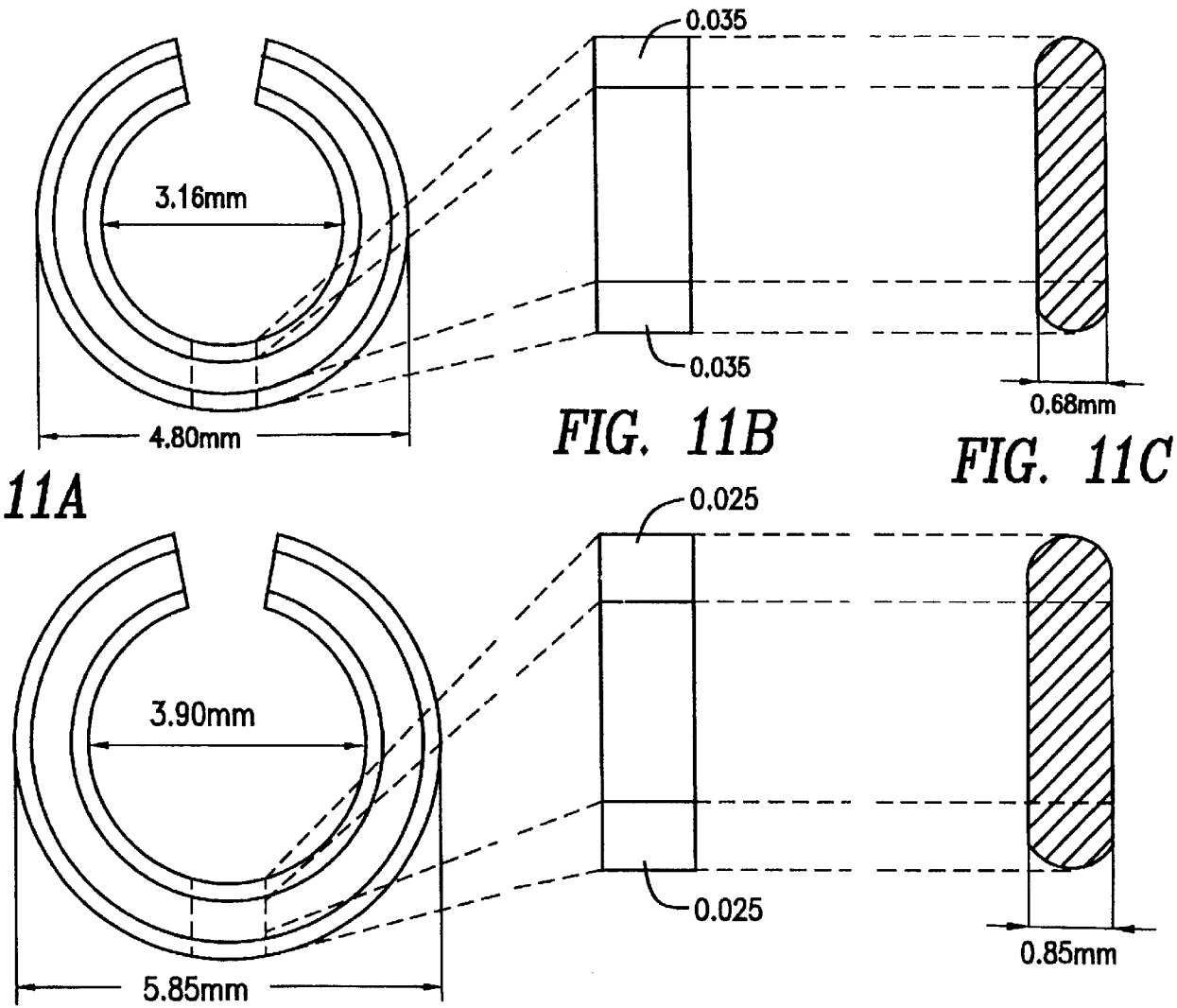
Figure 13:
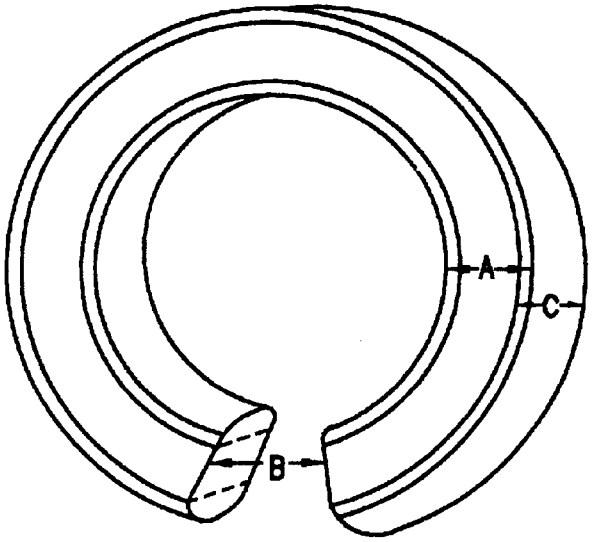
Figure 14A:
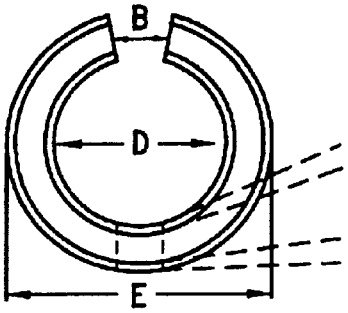
Figure 14B:
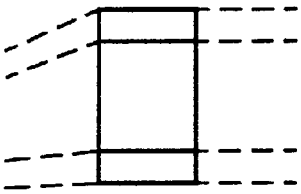
Figure 14C:
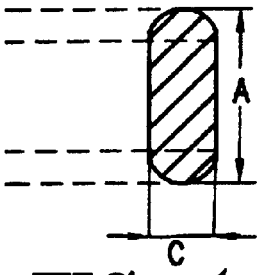

1.- All the results are based on the parameters shown in table 1.
2.- Column of FIG. 1 shows us the relationship that exists between the inner diameter of the flattened link (D) against the height of the flattened link (A).
For all calibres, the relation lies in the range of
D/A = 3.0:1 to 4.1:1
3.- Column of FIG. 2 shows us the increment of the height of the flattened link (F).
4.- Column of FIG. 3 shows us the ideal relationship of the transversal section of the flattened link. This relation corresponds to the wire diameter plus the increment for the flattening (A) against the thickness of the flattened link (C) A/C. This relationship is in the range of
A/C = 1.12:1 to 1.22:1
A > C
5.- Column of FIG. 4 shows us the relationship between the openness of the link (B) against the height of the flattened link (A): These links characterize for being just a little bit flattened B/A. This relation is in the range of
B/A = 1.023:1 to 1.080:1
B > A
Parameters of FIG. 4 are after the rope chain has been passed through the dies. We guarantee everything concerning to the fabrication of this kind of rope chain-3R.
If you like, we can send you samples of links in order for you to prove the relations. Also, we can send to you some inches of rope weaded with this kind of links.

What is claimed is:

1. A jewelry rope chain having tightly interfitting links made of wire of a given cross-section, each link having a small gap formed therein, so as to enable one of said links to pass through the gap of a second link, said links being intertwined to fit substantially tightly one against the other and form in outward appearance a double helix, each link having a wire cross-section including a major axis defining a longer dimension and a minor axis defining a shorter dimension, the longer dimension being in the plane of the link and the shorter dimension being perpendicular thereto, said links having a caliber number associated therewith, said caliber number being selected from a group of caliber numbers including caliber numbers 14, 016, 018, 021, 022, 025, 030, 035 and 040, each of said links further having a ratio of said longer dimension to said shorter dimension associated therewith, said ratio being in the range of from greater than 1.2:1 to less than 1.3:1, the ratio of the longer dimension to said shorter dimension for different caliber numbers being as follows:

| Caliber No. | Ratio of Longer Dimension to Shorter Dimension |
|---|---|
| 14 | 1.22:1 |
| 16 | 1.24:1 |
| 18 | 1.22:1 |
| 21 | 1.20:1 |
| 23 | 1.22:1 |
| 25 | 1.20:1 |
| 35 | 1.21:1. |

2. The jewelry rope chain of claim 1, in which the ratio range is greater than 1.2:1 and less than 1.24:1.

3. The jewelry rope chain of claim 1, in which the gaps of the chain links are wider than the longer dimension of the wire cross-section of said links.

* * * * *